United States Patent [19]

Bloom

[11] Patent Number: 5,035,013

[45] Date of Patent: Jul. 30, 1991

[54] FOLDABLE INFANT'S PLAY MAT WITH REMOVABLE SIDEGUARD

[75] Inventor: Stuart J. Bloom, Marlborough, Mass.

[73] Assignee: Pockets of Learning, Sudbury, Mass.

[21] Appl. No.: 538,237

[22] Filed: Jun. 14, 1990

[51] Int. Cl.[5] ..... A47D 3/00; A47D 13/06; A47C 21/08

[52] U.S. Cl. ..... 5/420; 5/424; 190/1; 190/2

[58] Field of Search ..... 5/424, 420, 417, 425, 5/418, 419; 190/1, 2

[56] References Cited

U.S. PATENT DOCUMENTS

| | | | |
|---|---|---|---|
| 2,078,022 | 4/1937 | Rolmer | 5/417 |
| 2,626,407 | 1/1953 | Kurry | 5/465 |
| 3,968,911 | 7/1976 | Haas | 5/424 |
| 4,788,726 | 12/1988 | Rafalko | 5/424 |
| 4,843,662 | 7/1989 | Handelman | 5/420 |

FOREIGN PATENT DOCUMENTS

| | | | |
|---|---|---|---|
| 1209228 | 2/1960 | France | 5/420 |
| 244177 | 12/1925 | United Kingdom | 5/417 |

OTHER PUBLICATIONS

J.C. Penney Catalog, p. 577, Section F (no date available!).

*Primary Examiner*—Alexander Grosz
*Attorney, Agent, or Firm*—Hamilton, Brook, Smith & Reynolds

[57] ABSTRACT

The portable infant's play mat has a cushioned base portion and a cushioned wall portion which follows the perimeter of the base portion. Securing means are provided to removable secure the wall portion to the base portion. Both the wall portion and the base portion are foldable along a bisecting axis. Handles attached to the base portion are provided opposite each other along an axis perpendicular to the bisecting axis, to provide carrying ease when the mat is in a folded position. The securing means may be either a zipper or straps of hook and pile cloth which wrap around the wall portion. Toys or other objects may be removably attached to such straps or alternatively patches of hook and pile cloth may be applied to the wall portion to allow such objects to be affixed thereto. Pockets on the base of the mat are upright when the mat is folded in a carrying position and may be used to store objects during transportation of the mat.

10 Claims, 6 Drawing Sheets

FOLDABLE INFANT'S PLAY MAT WITH REMOVABLE SIDEGUARD

BACKGROUND OF THE INVENTION

Mats of various types, both quilted and unquilted, plain and decorated are well known in the prior art. Mats which may be folded or rolled for portability and used as a floor covering upon which to place infants have also been shown. Diaper changing mats exist with permanently attached low walls of quilted material which serve to prevent articles from sliding or rolling off the mat.

SUMMARY OF THE INVENTION

In accordance with the present invention an infant's play mat is provided which has a cushioned base portion which is foldable along a bisecting axis. A cushioned wall portion follows the perimeter of the base portion, and is also foldable along the same bisecting axis. Securing means are provided to removably secure the base portion to the wall portion, allowing the two portions to be separated. Carrying handles are attached to the base portion and centered along an axis running perpendicular to the bisecting axis such that the handles come together in a carrying position when the base portion and the wall portion are folded along the bisecting axis.

The size of the wall portion is made large enough such that when the play mat is an open position the wall portion creates a psychological barrier which inhibits an infant on the mat from straying from the mat. In one embodiment the wall portion is secured to the base portion with a zipper, while in another embodiment straps permanently affixed to the base portion loop around the wall portion and attach to themselves to secure the two portions together.

Fasteners may be supplied along the surface of the wall portion positioned opposite each other relative to the bisecting axis, such that they meet and keep the two sides of the wall portion secured to one another when the mat is in a folded position. In one embodiment the fasteners are patches of hook and pile cloth, which allows the alternative of removably attaching objects to the patches of hook and pile cloth when the mat is in an open position.

An additional embodiment allows cushioning material in the base portion to be held in place with stitching in the base portion. To cover this stitching a decorative applique may be supplied which covers the stitching on the base portion.

DETAILED DESCRIPTION OF THE PREFERRED EMBODIMENT

Figure 1:
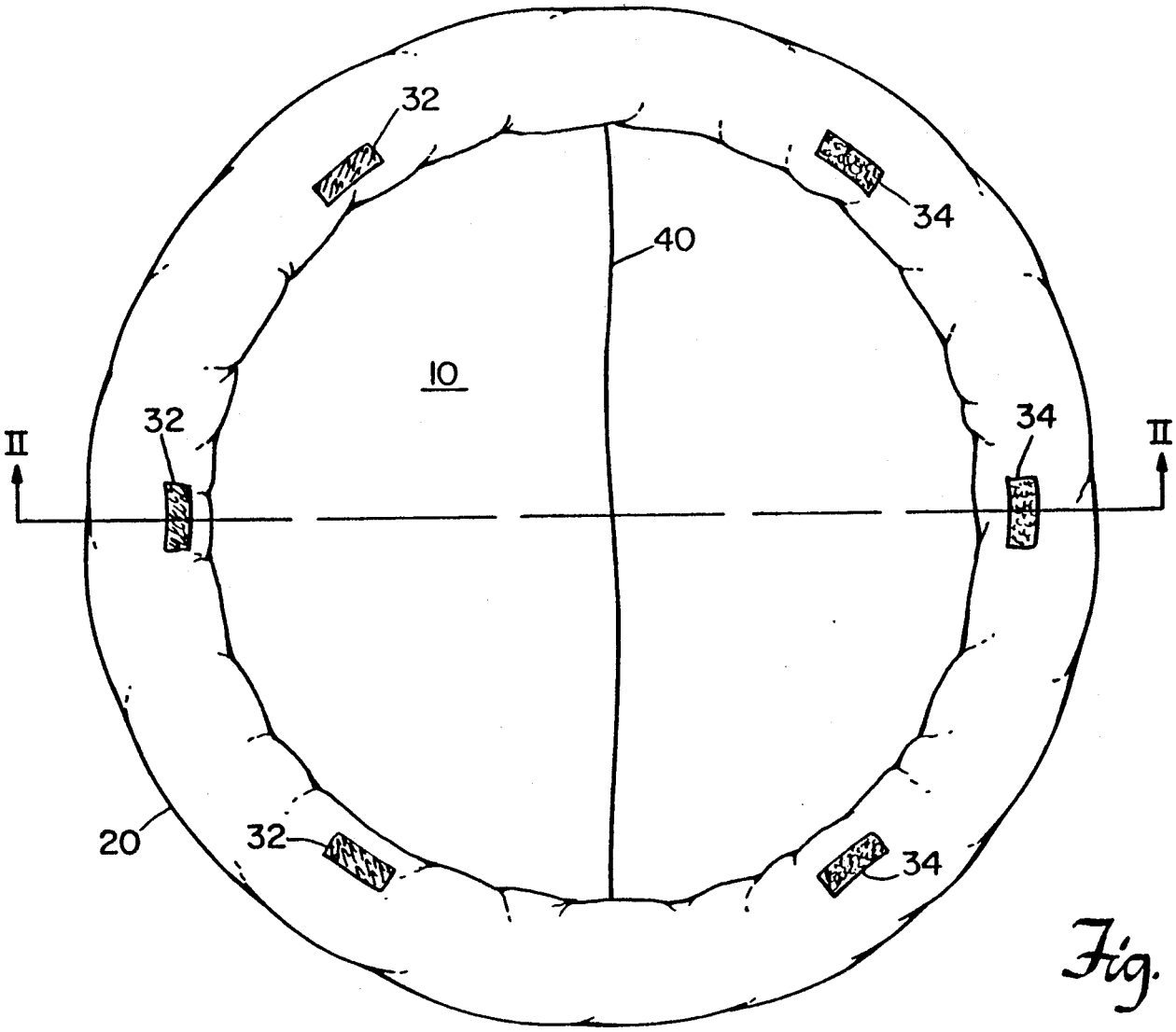
FIG. 1 is a plan view of the invention showing the play mat in its unfolded configuration.

The play mat is shown from the top in its unfolded configuration in FIG. 1. Base 10 is surrounded by wall 20, to which are attached Velcro ® "hook" strips 32 on one side of bisecting fold line 40 of base 10, and Velcro ® "loop" strips 34 on the opposite side of fold line 40. Velcro ® is a trademark for hook and pile cloth registered to Velcro USA. Hook strips 32 are positioned to meet loop strips 34 when the play mat is folded along fold line 40. In this way, the Velcro ® strips on one side of wall 20 fasten to strips on the opposite side of wall 20 to hold the play mat in a folded position.

Figure 2:
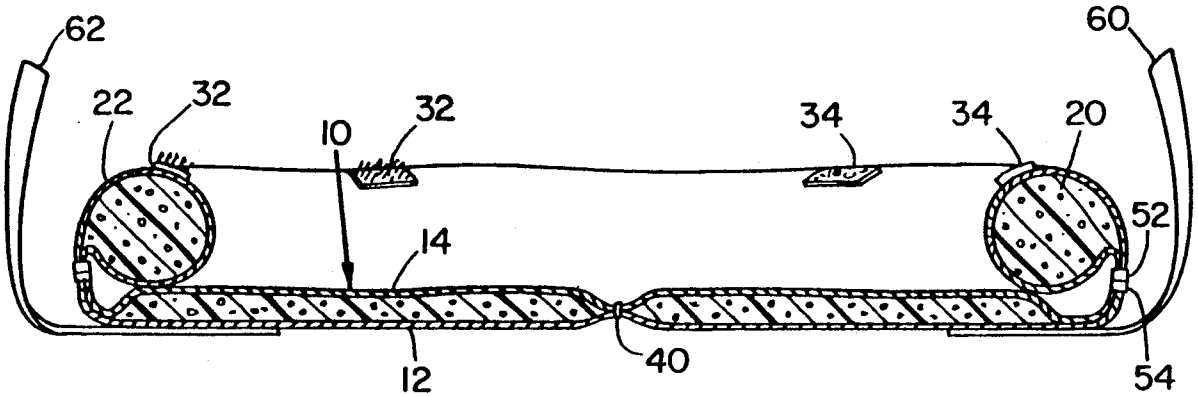
FIG. 2 is a sectional view of the invention viewed along section line 2—2 of FIG. 1.

The construction of the play mat is illustrated in FIG. 2, which is a sectional view taken along section line 2—2 of FIG. 1. Base 10 is constructed of bottom fabric sheet 12 and top fabric sheet 14 containing fiber or foam batting between them. In a preferred configuration, base 10 is separated into semicircular halves by stitching through the batting along fold line 40. Wall 20 is constructed of fabric shell 22 containing similar fiber or foam batting, and is removably attached to base 10 by means of zipper strip 52, which is zipped to mating zipper strip 54 sewn to base 10. By unzipping zipper 52–54, wall 20 may be detached from base 10 for purposes of washing or to create a sleeping mat out of base 10 alone.

Infant mats in the past have provided low walls surrounding a base mat. However, these walls did not provide a sufficient psychological barrier to keep the infant on the mat. The present invention takes this into consideration by providing wall 20 which is high enough and wide enough that an infant feels compelled to stay on the play mat 10.

In the preferred embodiment, the base 10 has a diameter of about 36 inches and a height of up to about 2 inches. The wall 20 is toroidally shaped with a cross sectional diameter of about 4 inches. The wall has an outside diameter which is greater than that of the base 10 such that the overall circumference of the play mat is defined by the outer circumference of the wall. When in its open position, the wall 20 extends about 3–4 inches above the top surface of the base 10, and the overall circumference of the wall in the open position is about 114 inches. The size of the wall 20 provides the necessary psychological barrier to help keep an infant on the mat from crawling out.

Fasteners such as Velcro ® strips 32 and 34 are positioned on the upper inside surfaces of wall 20 in order to engage each other when the play mat is folded along fold line 40. The strips are also used to hold toys, ornaments or other articles which would have a corresponding strip which would keep the toy or other articles removably fastened to the wall 20.

Also shown in FIG. 2 are cloth handles 62 and 64. In a preferred embodiment, cloth handles 62 and 64 are sewn to opposite sides of base 10 to facilitate carrying when the play mat is folded.

Figure 4:
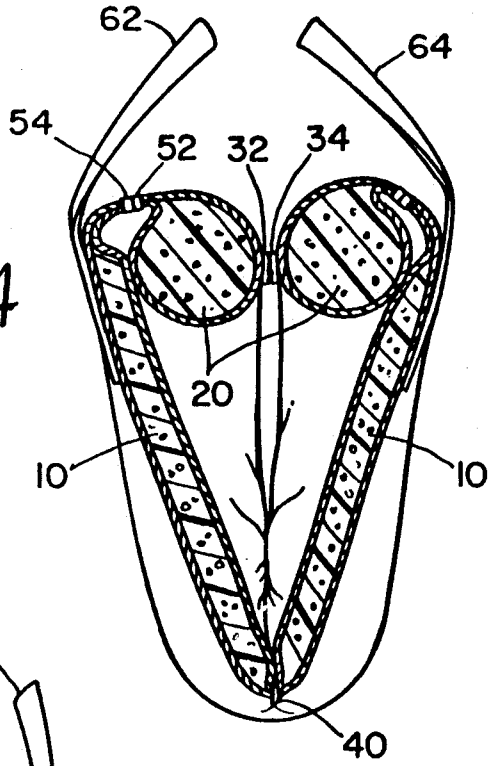
FIG. 4 is a sectional view of the invention viewed along section line 4—4 of FIG. 3.
Figure 3:
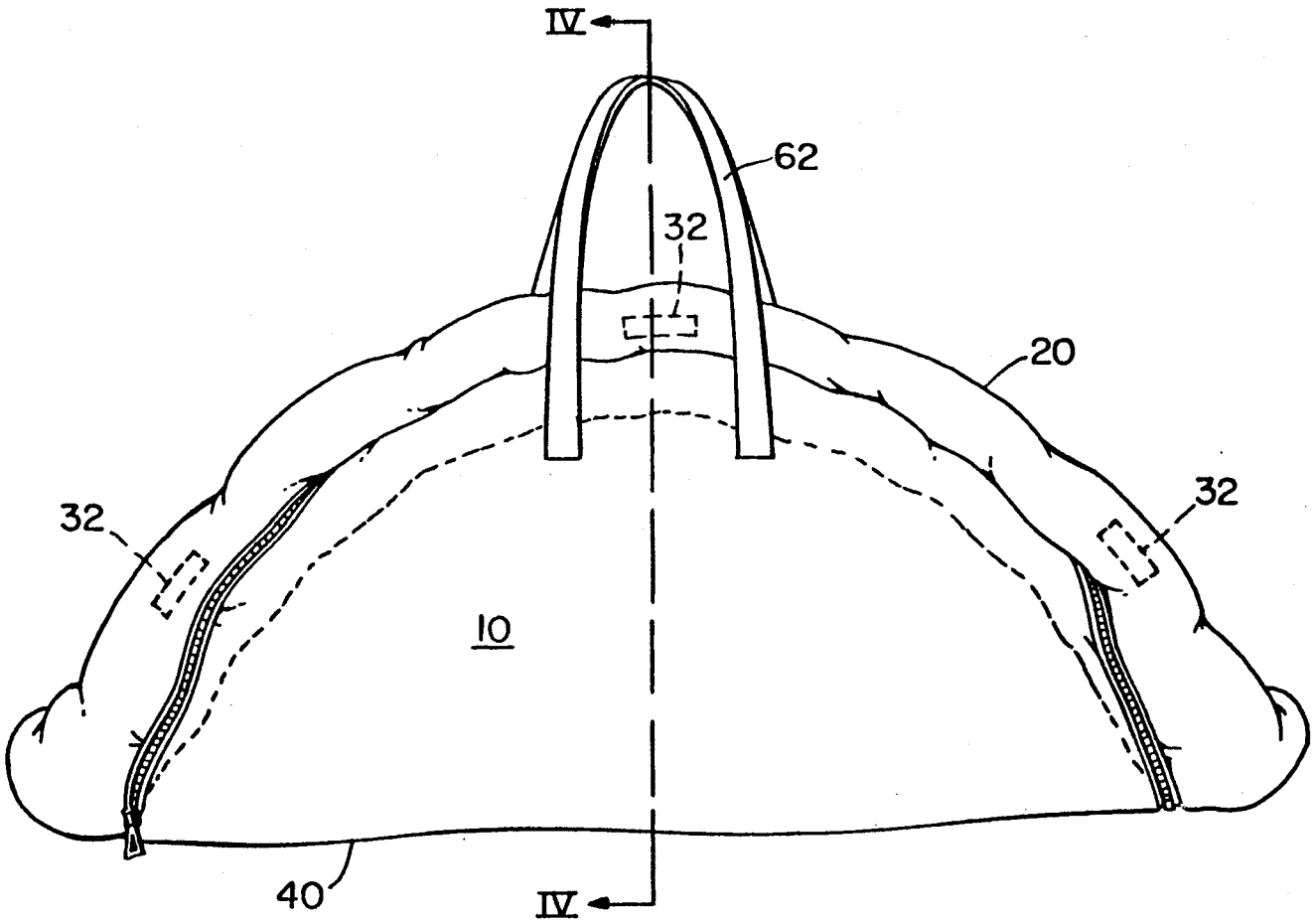
FIG. 3 is a side view of the invention showing the play mat in its folded configuration.

The play mat is illustrated in its folded configuration in FIG. 3, which shows a side view, and in FIG. 4, which is a sectional view taken along section line 4—4 of FIG. 3. The play mat is folded along fold line 40, such that hook Velcro ® strips 32 on one side of wall 20 attach to loop Velcro ® strips 34 on the opposite side of wall 20. In this configuration, base 10 and wall 20 form a closed bag, which may be conveniently carried using handles 62 and 64.

Figure 5:
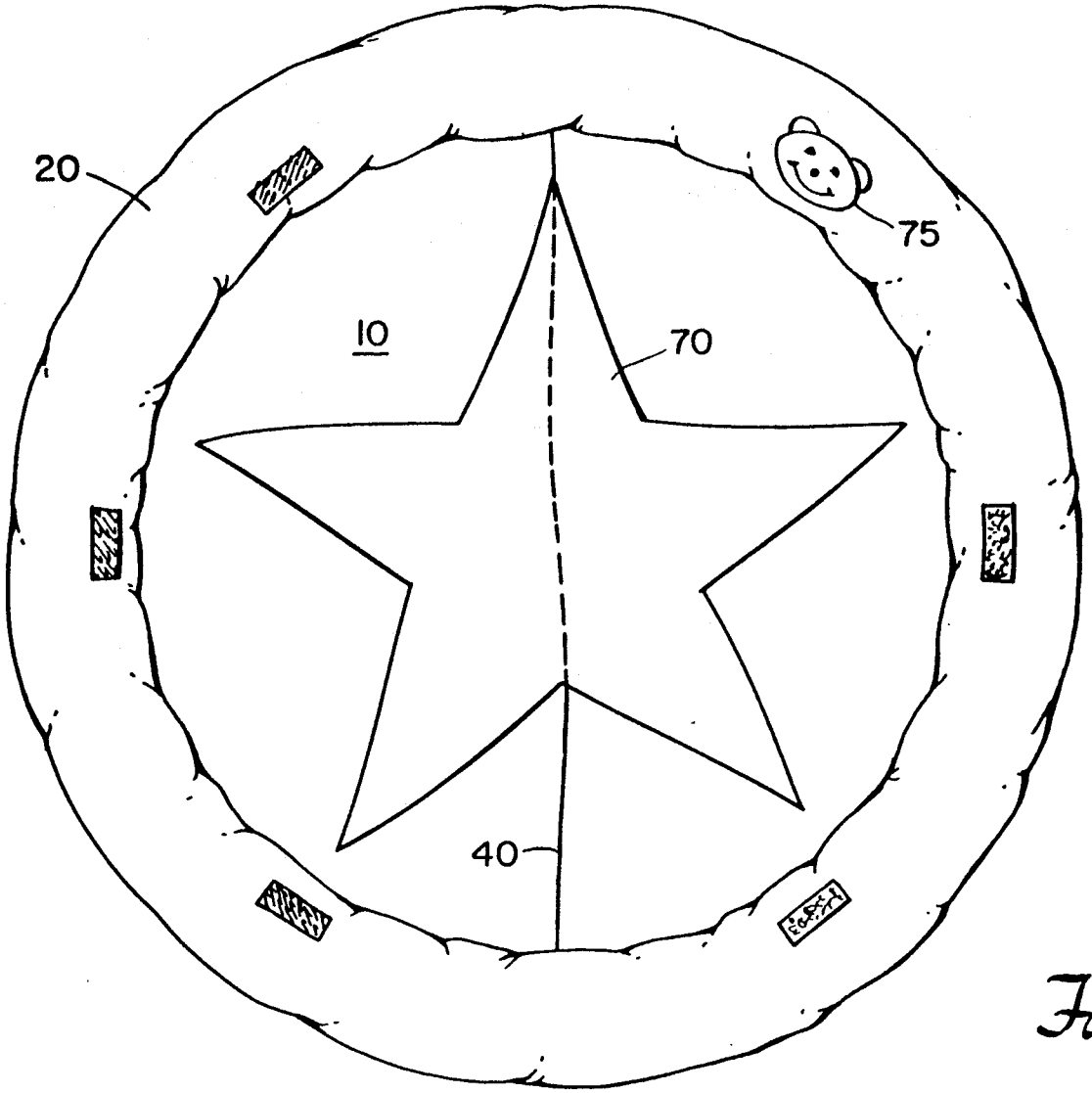
FIG. 5 is a plan view of an alternate version of the invention showing an applique overlaying the play mat.

In the embodiment shown in FIG. 5, decorative applique 70 is sewn onto the top surface of base 10 to conceal stitching underneath the applique. Such stitching is used to prevent shifting of the batting contained within base 10. Toy 75 is also shown in FIG. 5 removably affixed to one of the Velcro® strips 32, 34. The strips are one type of fasteners to which toys or objects may be fastened. Snaps or other fasteners may also be supplied for securing objects to the wall 20, or securing the wall to itself when the mat is in a folded carrying position.

Figure 6:
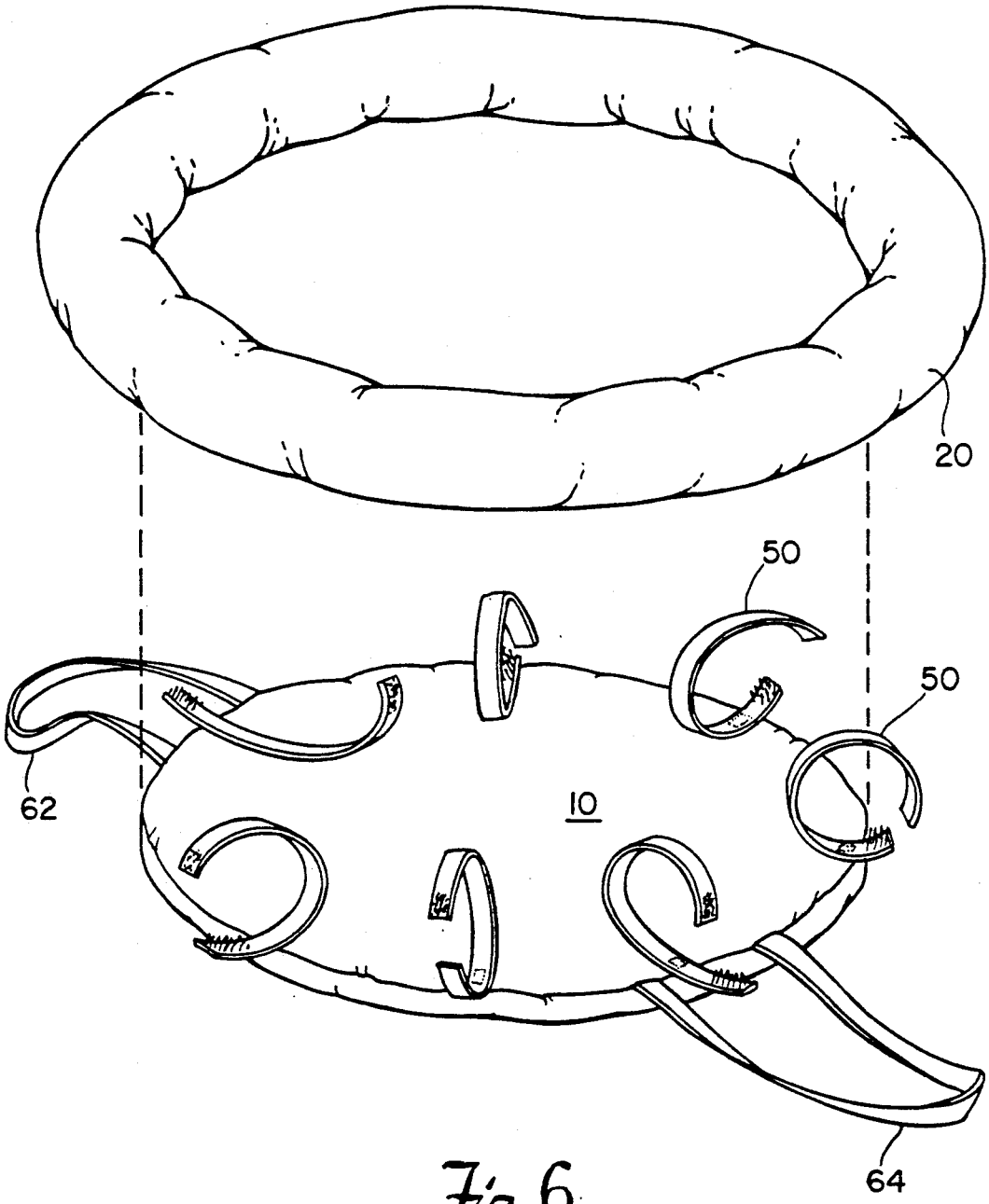
FIG. 6 is an exploded view of an alternative embodiment of the infant's play mat of the present invention.

As an alternative embodiment to the zippered securing means securing the base 10 to the wall 20, FIG. 6 shows an exploded view of a play mat which uses straps 50 to hold the two sections together. In this embodiment, the straps 50 are a two-sided Velcro® material, one side having "hook" cloth and the other having "loop" cloth. As shown, each strap 50 is attached to the base 10 near one end of the strap. Each strap 50 loops around the wall 20 and attaches to itself at the other end. Since the two sides of each strap are the two types of Velcro® material, the straps are removably retained in this position. Toys or other articles may still be attached to the wall portion by providing them with the appropriate Velcro® material so they may be affixed to the straps 50.

Figure 7:
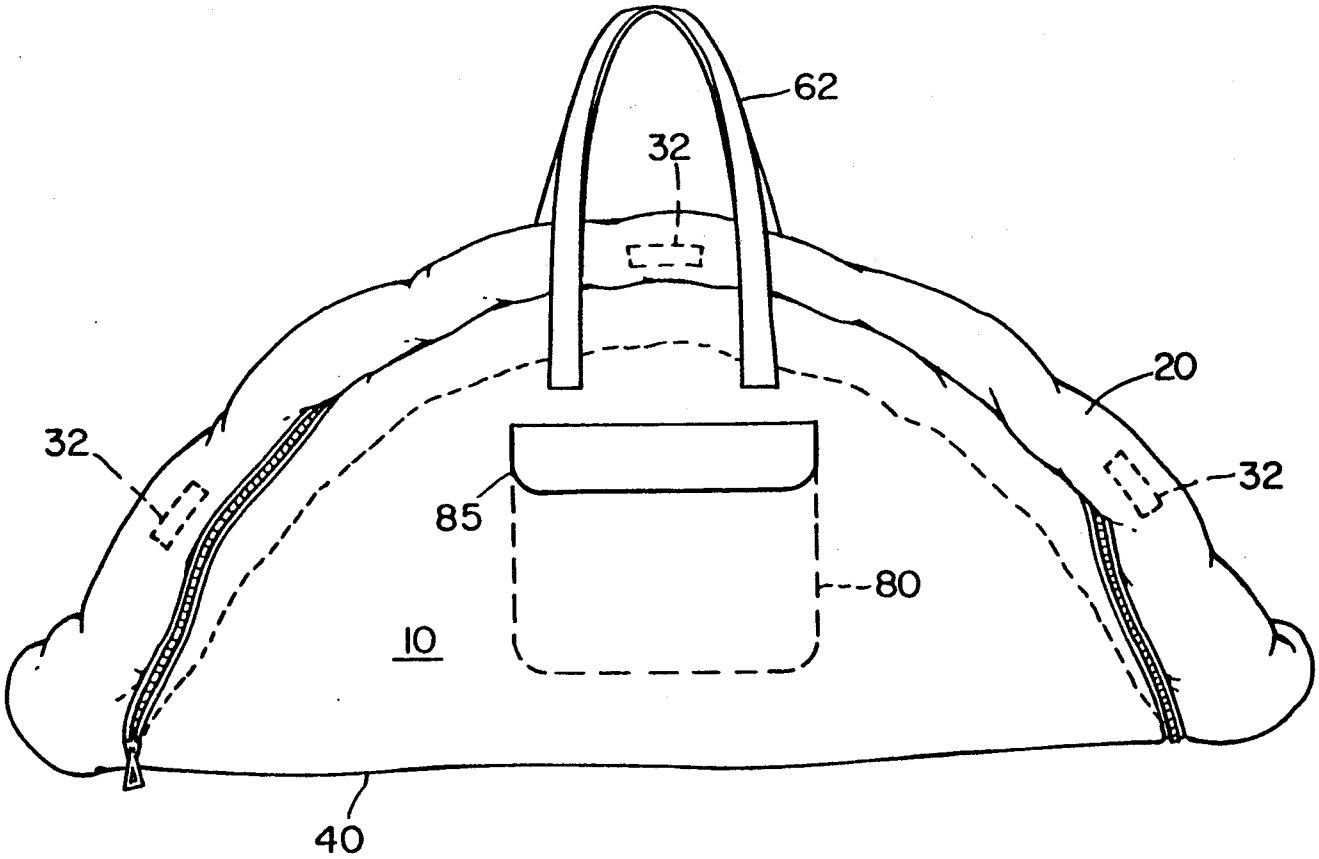
FIG. 7 shows an embodiment of the infant's play mat in a carrying position and having a pocket sewn into the base.

In another alternative embodiment, a pocket 80 is sewn into or onto the outside of the play mat to provide a convenient place for carrying objects such as toys when transporting the mat. As shown in FIG. 7, pocket 80 is provided on the bottom side of base 10 of the mat such that when the mat is in a carrying position the pocket 80 is upright. The top of the pocket 80 has a flap 85 for a closure to prevent objects from falling out of the pocket 80. The closure may be secured by a zipper, snaps, Velcro®, or the like. More than one pocket 80 may be provided on either side of the bottom of base 10 to provide multiple storage places.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. An infant's play mat comprising:

a cushioned base portion foldable along an axis at least partially defined by stitching;

a cushioned wall portion following the perimeter of the base portion, the wall portion being foldable along the axis;

a securing means for removably securing the base portion to the wall portion, said securing means comprising a zipper strip attached to the base portion and a mating zipper strip attached to the wall portion;

at least one carrying handle; and fastening means comprising mating hook and loop fasteners for fastening one side of the play mat to an opposite side of the play mat when the play mat is in a folded position.

2. A play mat according to claim 1 wherein the wall portion extends from the base portion far enough to provide a psychological barrier to inhibit an infant on the mat from straying from the mat.

3. A play may according to claim 1 further comprising further fastening means along the wall portion surface to which an object may be removably attached.

4. A play mat according to claim 1 wherein said fastening means comprises a first fastener positioned on the wall portion and a second fastener positioned on the wall portion opposite the first fastener such that the two fasteners meet when the mat is in a folded position to secure the mat in the folded position.

5. A play mat according to claim 1 wherein cushioning material in the base portion is held in place with stitching in the base portion.

6. A play mat according to claim 5 further comprising a decorative applique covering said stitching in the base portion.

7. A play mat according to claim 1 further comprising a pocket attached to the play mat.

8. A play mat according to claim 7 wherein the pocket is attached to the mat in such a manner that the pocket is in an upright position when the play mat is folded in a carrying position.

9. A play mat according to claim 7 further comprising a pocket closure.

10. A portable infant's play mat comprising:

a soft, fabric base portion having a filling of cushioning material, the base portion being substantially flat with the cushioning material providing a thickness sufficient to cushion an infant from a hard, underlying surface on which the base portion is rested, the base portion being foldable along an axis at least partially defined by stitching;

a soft, fabric wall portion following the perimeter of the base portion and extending away from the base portion toward the side of the base portion on which an infant is placed, the wall portion having a filling of cushioning material providing a height and thickness such that a cushioned border is formed surrounding the base portion, the wall portion being foldable along said axis;

securing means for removably securing the wall portion to the base portion, said securing means comprising a zipper strip attached to the base portion and a mating zipper strip attached to the wall portion;

at least one carrying handle; and fastening means comprising mating hook and loop fasteners for fastening one side of the play mat to an opposite side of the play mat when the play mat is in a folded position.

* * * * *